US010960633B2

(12) United States Patent
Onodera et al.

(10) Patent No.: US 10,960,633 B2
(45) Date of Patent: Mar. 30, 2021

(54) METHOD FOR FORMING MOLDED ARTICLE BY PRESS MOLDING

(71) Applicant: Hitachi Chemical Company, Ltd., Tokyo (JP)

(72) Inventors: Satoshi Onodera, Matsudo (JP); Katsuhiko Ueda, Matsudo (JP); Tomoyuki Kohida, Yachimata (JP); Junichi Ichikawa, Matsudo (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 181 days.

(21) Appl. No.: 15/552,654

(22) PCT Filed: Mar. 18, 2016

(86) PCT No.: PCT/JP2016/058705
§ 371 (c)(1),
(2) Date: Aug. 22, 2017

(87) PCT Pub. No.: WO2016/152778
PCT Pub. Date: Sep. 29, 2016

(65) Prior Publication Data

US 2018/0036984 A1 Feb. 8, 2018

(30) Foreign Application Priority Data

Mar. 20, 2015 (JP) ..... 2015-057780

(51) Int. Cl.
*B30B 15/00* (2006.01)
*B30B 11/00* (2006.01)
(Continued)

(52) U.S. Cl.
CPC ..... *B30B 15/0088* (2013.01); *B22F 3/03* (2013.01); *B30B 11/00* (2013.01); *B30B 11/02* (2013.01);
(Continued)

(58) Field of Classification Search
CPC ..... B22F 2003/026; B22F 3/03; B22F 2003/033; B30B 15/0088; B30B 15/0011
(Continued)

(56) References Cited

U.S. PATENT DOCUMENTS 3,220,092 A * 11/1965 Wolfe ..... F16O 33/14 419/6
3,366,479 A * 1/1968 Storchheim ..... B22F 3/12 419/36
(Continued)

FOREIGN PATENT DOCUMENTS

CN 105659337 A 6/2016
JP S49-046506 A 5/1974
(Continued)

OTHER PUBLICATIONS

Hsiang Shih and P. J. Flory. "Equation-of-State Parameters for Poly(dimethylsiloxane" vol. 5, No. 6, Nov.-Dec. 1972. pp. 758-761 (Year: 1972).*
(Continued)

*Primary Examiner* — Anthony J Zimmer
*Assistant Examiner* — Sean P. O'Keefe
(74) *Attorney, Agent, or Firm* — Oliff PLC

(57) ABSTRACT

Method of forming a compact based on the press forming method provides a compact having high density and not having cracking or surface roughness in a product and without compact adhesion to press forming mold wall occurring, including steps: filling raw material powder in a cavity formed by an outer mold and lower punch, or outer mold and lower punch and core rod, pressing and forming raw material powder between an outer punch and lower punch, and extracting the compact obtained out of the outer mold by the lower punch, wherein a lubricating film of a press forming mold lubricant containing oil as main com-
(Continued)

ponent is formed on at least part of outer mold inner surface, or outer mold inner surface and core rod outer circumferential surface before filling the raw material powder in the cavity, and press forming so that compact density ratio is not less than 93%.

11 Claims, 3 Drawing Sheets

(51) Int. Cl.
*C10M 171/02* (2006.01)
*B22F 3/03* (2006.01)
*B30B 11/02* (2006.01)
*B22F 3/02* (2006.01)

(52) U.S. Cl.
CPC ..... *B30B 15/0011* (2013.01); *C10M 171/02* (2013.01); *B22F 2003/026* (2013.01)

(58) Field of Classification Search
USPC ..... 419/66
See application file for complete search history.

(56) References Cited

U.S. PATENT DOCUMENTS 3,676,030 A * 7/1972 Roepenack ..... B22F 3/02 425/78
3,687,657 A * 8/1972 Storchheim ..... C22C 1/0416 419/32
4,338,750 A * 7/1982 Ratterman ..... B24B 1/00 106/287.13
4,401,498 A * 8/1983 Jahn ..... A61K 6/10 156/307.1
5,682,591 A 10/1997 Inculet et al.
2008/0219610 A1* 9/2008 Nakatani ..... B60B 27/00 384/462
2013/0102506 A1* 4/2013 Yoshida ..... C10M 171/00 508/249
2013/0300021 A1 11/2013 Hirai
2015/0118163 A1* 4/2015 Bhagat ..... A61K 49/0021 424/9.6
2015/0133353 A1* 5/2015 Arai ..... C10M 169/02 508/304
2016/0097017 A1* 4/2016 Eisenberg ..... C08F 290/048 508/503
2016/0145432 A1* 5/2016 Jujii ..... C08L 81/04 428/66.4

FOREIGN PATENT DOCUMENTS

JP S55141501 A 11/1980
JP S56-158246 A 12/1981
JP H08-100203 A 4/1996
JP H09-272901 A 10/1997
JP H1113765 A 1/1999
JP 2009-120918 A 6/2009
JP 2009120918 A * 6/2009
JP 2012-234871 A 11/2012
KR 20140106107 A 9/2014
WO 2012/147461 A1 11/2012

OTHER PUBLICATIONS

Machine translation of JP2009-120918 A (Year: 2009).*
May 31, 2016 International Search Report issued in International Patent Application No. PCT/JP2016/058705.

* cited by examiner

| Thickness of lubricating film | 3 μm | 5 μm |
|---|---|---|
| Pore distribution (100 μm) |  |  |
| Surface layer density | 7.45 $Mg/m^3$ | 7.43 $Mg/m^3$ |

| Thickness of lubricating film | 20 μm | 40 μm |
|---|---|---|
| Pore distribution (100 μm) |  |  |
| Surface layer density | 7.42 $Mg/m^3$ | 7.40 $Mg/m^3$ |

| Thickness of lubricating film | 60 μm |
|---|---|
| Pore distribution (100 μm) |  |
| Surface layer density | 7.32 $Mg/m^3$ |

METHOD FOR FORMING MOLDED ARTICLE BY PRESS MOLDING

TECHNICAL FIELD

The present invention relates to a method of forming a compact using a powder metallurgical method, and in particular, relates to a method of forming a compact by a press forming method.

BACKGROUND ART

A forming method in a powder metallurgical method is classified generally as a press forming method, an injection forming method, an extruding forming method, a wet forming method and the like. Among these forming methods, the press forming method in which sintered parts can be produced at low cost is primarily employed because yield of raw material is high since it can be shaped to near-net-shape, because many compacts having the same shape can be produced when a metallic mold is produced once, because a shorter time is required for degreasing, and the like.

In the press forming method, a mold apparatus is used which includes a mold cavity of an outer mold forming an outer circumferential shape of a product, a lower punch slidably engaged with the mold cavity and forming a lower edge surface of the product, and an upper punch slidably engaged the mold cavity and forming an upper edge surface of the product. The press forming method includes a filling process in which raw material powder is filled in the cavity formed by the mold cavity and the lower punch, a forming process in which the raw material powder filled in the cavity is pressed and formed by the upper punch and the lower punch so as to form a compact having desired shape, and an extracting process in which the compact obtained is extracted from a mold cavity of the outer mold, these processes being performed in this order. In such a press forming method, a compact having a complicated shape can be formed by using multiple upper punches and lower punches and by performing multiple steps. Furthermore, a product having an axis hole can be formed by arranging a core rod.

In the forming process of such a press forming method, since pressure expanding to a vertical direction of forming pressure is imparted to the compact by the forming pressure during forming, and the compact contacts tightly on a wall surface of a press forming mold (inner circumferential surface the mold cavity of the outer mold), friction may occur between the press forming mold wall surface and the compact during the extracting process. If this frictional force is large, the compact may adhere to the press forming mold wall surface or the surface roughness of the compact may increase. In addition, if friction between the compact and the press forming mold wall surface is increased, a larger pressing force to cancel the friction may be required. Since residual stress in the compact may increase with the larger pressing force, cracking may easily occur in the compact due to excess stress during the extracting process. Therefore, in the press forming method, various kinds of lubricating methods are employed in order to reduce friction that occurs between the press forming mold wall surface and the compact.

The lubricating method in the press forming method is classified generally as a press forming mold lubricating method and an interfusion lubricating method. The press forming mold lubricating method is a method in which lubricant is preliminarily coated on a forming surface of the press forming mold such as an inner surface of the press forming mold and surface of the core rod, and after that, the raw material powder is filled and formed. The lubricant coated on the forming surface of the press forming mold exists between the forming surface of the press forming mold and the compact, and friction during the extracting process can be reduced. The interfusion lubricating method is a method in which powdered lubricant is added and mixed in the raw material powder, and then, the mixture is filled and formed. The lubricant melted by frictional heat seeps out between the forming surface of the press forming mold and the compact during extracting process, and friction between the forming surface of the press forming mold and the compact is reduced. It should be noted that in the Japanese Industrial Standards (JIS Z2500-1960) regarding terms of powder metallurgy, a lubricant coated on the press forming mold is called "press forming mold lubricant" and a lubricant mixed in the raw material powder is called "powder lubricant"; however, there is no difference in raw material of the lubricants, and a metallic soap such as stearic acid and metallic salts thereof, waxes or the like is generally used.

In recent years, in the sintered parts or the like produced by a powder metallurgical method, it has been required to increase strength. High strengthening of the sintered parts can be accomplished by using high-grade raw material; however, since raw material cost is increased in that case, advantages of the press forming method in which the sintered parts can be produced at lower cost is lost. In the press forming method, gaps between the raw material powder remain in the compact after forming, and these gaps may be dispersed in the sintered parts as a pore after sintering. As typical iron based sintered parts, parts having density ratio (ratio of density of a porous material to density of material having the same material composition and having no pores) of 83 to 90% (remainder being pores) is produced. These pores cause degradation of the strength of mechanical parts. Therefore, since the sintered parts having high strength can be accomplished without upgrading raw material if the compact is formed with high density, various methods of forming a compact having high density have been researched.

As the lubricating method in the press forming method, the interfusion lubricating method is typically applied from the viewpoint that the method can be easily performed and is appropriate for mass-production. However, in the interfusion lubricating method, there is a problem of decreasing flowability of the raw material powder, strength of the compact, and powder compacting density due to adding the powdered lubricant. Therefore, there are cases in which the press forming mold lubricating method is employed in order to obtain a compact having high density.

As the press forming mold lubricating method, a method has been researched in which powdered lubricant which is electrically charged by friction is electrostatically adhered on the press forming mold so that a solid lubricating film is formed on the press forming mold wall surface (see Patent Document 1).

In addition, as the press forming mold lubricating method, a method has been researched in which powdered lubricant is dispersed in a solvent such as an organic solvent, the dispersion is coated on the press forming mold wall surface, the coating is dried to remove the solvent, and a solid lubricating film is formed on the press forming mold wall surface (see Patent Documents 2 and 3). As the method of coating the press forming mold lubricant dispersed in the organic solvent on the forming surface of the press forming mold, a coating method by spraying or brushing on is performed (see Patent Document 2). However, it is difficult to uniformly coat the press forming mold lubricant on a surface sliding and contacting with the compact in the press forming mold by the spraying or brushing on. Therefore, as a method of uniformly coating the press forming mold lubricant on the forming surface of the press forming mold, a method has been developed in which the powder forming mold itself is used as a coating means of the press forming mold lubricant, and a press forming mold lubricant which is a dispersant in which particles of solid lubricant is dispersed in a liquid solvent that is not flammable is coated (see Patent Document 3).

The Patent Documents are as follows:

Patent Document 1: Japanese Unexamined Patent Application Publication No. Hei08(1996)-100203

Patent Document 2: Japanese Unexamined Patent Application Publication No. Hei09(1997)-272901

Patent Document 3: Japanese Unexamined Patent Application Publication No. 2012-234871

However, in the method disclosed in the Patent Document 1, in a case in which a mold cavity is deep or in a case in which shape of a product is complicated, it is difficult to form the lubricating film uniformly deep inside the deep cavity or on each part of the press forming mold wall surface having a complicated shape. Furthermore, in the methods of the Patent Documents 2 and 3 in which the powdered lubricant is dispersed in a solvent such as an organic solvent, the dispersion is coated on the press forming mold wall surface, the coating is dried to remove the solvent and the solid lubricating film is formed on the press forming mold wall surface, there may be environmental problems due to handling of organic solvents, a problem of decreasing production rate since time is required to dry the organic solvent, and the like.

Furthermore, lubricants used in the abovementioned press forming mold lubricating method mainly contain the solid lubricant such as a metallic soap such as stearic acid or metallic salts thereof, waxes or the like. The lubricating film of the solid lubricant exhibits superior lubricating effects in a region of static friction in which frictional resistance with the outer mold is overcome and the compact begins moving; however, lubricating effects are not great in a region of kinetic friction after the compact begins moving, and during forming a compact having high density which is required in recent years, there may be a case in which sufficient lubricating effect is not obtained.

SUMMARY OF THE INVENTION

The present invention has been completed in view of the above circumstances, and an object of the present invention is to provide a method of forming a compact in a press forming method in which a compact having high density can be formed without the occurrence of cracking, without surface roughness, without adhesion on the press forming mold wall surface or the like.

The inventors have focused on the press forming mold lubricating method and have researched application of a liquid lubricant. An oil is generally used as a lubricant for plastic forming metal; however, if the oil is used in the press forming mold lubricating method in press forming metallic powder in the pressing mold, the oil may penetrate into the raw material powder or into the compact, the amount of lubricant between the pressing mold and compact may become insufficient, and lubrication may be insufficient. Therefore, in the lubricant in the above press forming mold lubricating method, one which contains solid lubricant such as a metallic soap such as stearic acid or metallic salts thereof, waxes or the like as a main component are generally used. However, the inventors have found that if raw material powder is formed in high density by using a liquid lubricant in the press forming mold lubricating method, some of the liquid lubricant which was absorbed in the powder by capillary action is pressed out of the powder to between the compact and the press forming mold wall surface by forming pressure, and superior lubricating effect can be exhibited during the extracting process.

The method of forming a compact using a press forming method of the present invention is based on the above knowledge, and includes the following steps: forming a lubricating film of a press forming mold lubricant containing an oil as a main component at least on a part of an inner surface of the outer mold, on a part of an inner surface of the outer mold and an outer circumferential surface of the core rod, on a part of a surface of at least one of multiple lower punches which form a compact having multiple steps at lower side in a case in which surfaces of the multiple lower punches form the compact having multiple steps at a lower side, and on a part of surface of at least one of multiple upper punches which form a compact having multiple steps at an upper side in a case in which surfaces of the multiple upper punches form the compact having multiple steps at an upper side, filling raw material powder in a cavity, and pressing the compact so that the density ratio of the compact is not less than 93%.

In the method of forming a compact based on a press forming method of the present invention, it is desirable that thickness of the lubricating film be 5 to 40 μm, that viscosity of the press forming mold lubricant at 25° C. be 10 to 100000 mPa·s, and that the press forming mold lubricant contain a solid lubricant.

According to the method of forming a compact based on the press forming method of the present invention, a method can be provided in which an appropriate compact having high density ratio not less than 93% and not having cracking and surface roughness can be formed and extracted from the press forming mold without the occurrence of adhesion to the press forming mold wall.

EXPLANATION OF REFERENCE NUMERALS

Figure 1A:
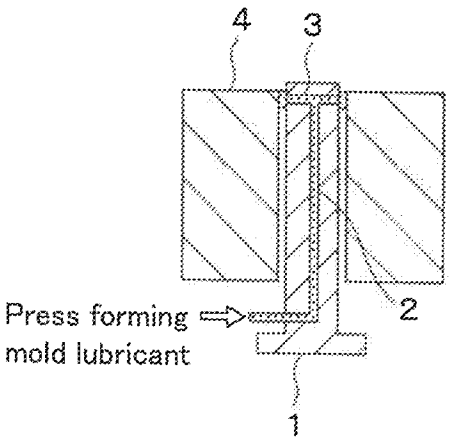
FIG. 1 is a conceptual diagram showing a process of one embodiment of the method of forming a compact of the present invention.

1: lower punch, 11: primary lower punch, 12: secondary lower punch, 2: oil pathway, 3: press forming mold lubricant holding groove, 4: outer mold, 5: lubricating film, 6: cavity, 7: raw material powder, 8: upper punch, 81: primary upper punch, 82: secondary upper punch, 9: compact, 10: core rod.

BEST MODE FOR CARRYING OUT THE INVENTION

In the method of forming a compact of the present invention, that is, a so-called press forming method in which the raw material powder is filled in the cavity formed by an outer mold and a lower punch, or formed by an outer mold, a lower punch and a core rod, the raw material powder is pressed and formed between the upper and lower punches, and the compact obtained is pushed out of the outer mold by the lower punch, the first technical feature is that the lubricating film of the press forming mold lubricant containing oil as a main component is formed on inner surface of the outer mold of the powder forming mold (press forming mold), and the second technical feature is that the compact is formed so that the density ratio is not less than 93%.

By forming the lubricating film of the press forming mold lubricant containing oil as a main component on an inner surface of the outer mold, even in a case in which the compact having a high density with a density ratio of not less than 93% is formed and extracted from the outer mold, superior lubricating effect is obtained, and an appropriate compact not having cracking and product surface roughness can be formed and extracted from the press forming mold without the occurrence of adhesion to the press forming mold wall.

It should be noted that if the press forming mold lubricant is coated on a part forming the cavity, that is, at least on a part of an inner surface of the outer mold, on a part of an inner surface of the outer mold and the outer circumferential surface of the core rod, on a part of a surface of at least one of multiple lower punches which form a compact having multiple steps at a lower side in a case in which surfaces of the multiple lower punches form the compact having multiple steps at a lower side, and on a part of a surface of at least one of multiple upper punches which form a compact having multiple steps at an upper side in a case in which surfaces of the multiple upper punches form the compact having multiple steps at an upper side, desirably at a position at which the surface of the densely pressed compact is pressed, a sufficient lubricating effect can be obtained when the compact is extracted from the press forming mold while sliding with the press forming mold.

In the present embodiment, the oil which is used as the main component of the press forming mold lubricant is not limited in particular, and at least one kind selected from a mineral oil of the paraffin type, naphthene type or the like, and a synthetic oil of the hydrocarbon oil type, polyether type, ester type, phosphorus compound type, silicon compound type, halogen compound type or the like can be used. It should noted that the main component in the present invention means a component having a ratio of not less than 50 mass % of the entire composition.

In the present embodiment, as the pressing forming mold lubricant, one can be selected in which oil as a main component contains solid lubricant. By adding the solid lubricant in the oil, lubricating effect is further improved, in particular, a lubricating effect in a region of kinetic friction. In addition, a lubricating effect in a region of static friction is also superior. As the solid lubricant, graphite, metal sulfide such as molybdenum disulfide, metallic soap, and waxes can be used without any limitation. In particular, from the viewpoint of reliability and the environment, graphite is desirable. As such a graphite, one having an average particle diameter of 1 to 50 μm is desirable. It is desirable that the amount of the solid lubricant contained be about 1 to 20 mass % in total of the amount of the press forming mold lubricant.

In the present embodiment, the press forming mold lubricant can contain an additive such as an antioxidant, viscosity index improving agent, pour-point depressant, extreme-pressure agent for the purpose of preventing deterioration and controlling of lubricating performance. As the antioxidant, it is not limited in particular, and an organic sulfur compound such as an aliphatic sulfide, a sulfur-containing metallic complex such as zinc dialkyldithiophosphate, phenols, aromatic amines or the like can be used alone or in combination of two kinds or more. As the viscosity index improving agent, it is not limited in particular, and a polymer such as polymethacrylate, ethylene-propylene copolymer or the like can be used alone or in combination of two kinds or more. As the pour-point depressant, polymethacrylate type, an alkylaromatic compound or the like can be used without any limitation. As the extreme-pressure agent, it is not limited in particular, and a compound which forms an adsorption film, tribochemical reaction film or adhesion film on a friction surface, such as sulfur type compounds, phosphorus type compounds, and halogen type compounds can be used alone or in combination of two kinds or more.

In the present embodiment, it is desirable that viscosity of the press forming mold lubricant at 25° C. be 10 to 100000 mPa·s. The lubricating film is unlikely to be broken in a case in which viscosity at 25° C. is not less than 10 mPa·s, and flowability is sufficient and the press forming mold lubricant can be easily supplied by a pump or the like in a case in which it is not more than 100000 mPa·s. It should be noted that viscosity of the press forming mold lubricant was measured using a viscometer (trade name: BL2) produced by TOKYO KEIKI INC. under conditions of using a No. 2 rotor, rotation rate 60 $min^{-1}$, and at 25° C.

As the raw material powder in the present embodiment, metallic powder such as of iron, copper, aluminum, titanium or the like, and alloy powders thereof can be used alone or mixed at a specific ratio, and furthermore, additive material such as graphite can be added. In particular, an iron based powder, which is generally used for sintering machine parts or powder magnetic core, can be appropriately used in high density forming.

In the method of forming a compact of the present embodiment, the raw material is formed so that density ratio of the compact is not less than 93%. In a case in which the raw material is formed so that density ratio of the compact is not less than 93%, gaps among the powder in the compact is decreased, the press forming mold lubricant penetrating into the raw material during pressing and forming process is squeezed out of the compact, sufficient amount of press forming mold lubricant can be held between the outer mold and the compact. Due to this effect, in spite of a force that presses the compact to the inner surface of the outer mold being larger than in a case in which density of a compact is low, lubrication during extraction of the compact from the outer mold is superior. It should be noted that pressing and forming to obtain density ratio of the compact not less than 93% using iron based powder corresponds to a case in which a raw material containing iron powder and 0.3 mass % of graphite powder is formed so that compact density is not less than about 7.3 $Mg/m^3$, for example.

In the present embodiment, it is desirable that thickness of the lubricating film be 5 to 40 μm. There is a tendency for adhesion to occur on the press forming mold wall surface in which the thickness of the lubricating film is less than 5 μm, and there is a tendency of surface density to decrease by the lubricant penetrating into the surface layer of the compact in a case in which thickness is greater than 40 μm. It should be noted that the thickness of the lubricating film can be measured by Fourier transformation infrared spectroscopy (FT-IR method).

Figure 1B:
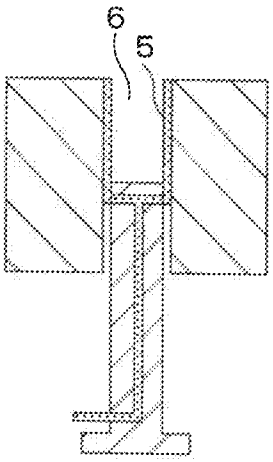
Figure 1C:
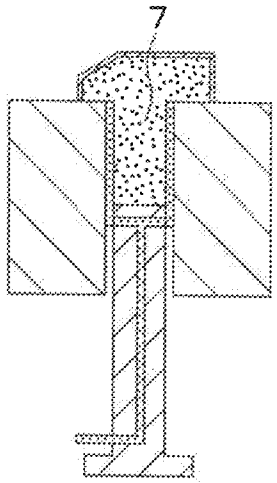

One embodiment of the method for forming a compact of the present invention is explained by way of FIGS. 1A to 1E. As shown in FIG. 1A, an oil pathway 2 is formed inside of a lower punch 1, and in addition, a press forming mold lubricant holding groove 3 is formed near an upper edge of the lower punch 1. One end of the oil pathway 2 is connected to a pump (not shown), and the other end is connected to the press forming mold lubricant holding groove 3. Press forming mold lubricant is supplied by the pump via the oil pathway 2 to the press forming mold lubricant holding groove 3, and is further supplied to a gap of outer mold 4 and the lower punch 1. Next, as shown in FIG. 1B, the outer mold 4 moves upward of the lower punch 1 to form a cavity 6 for filling raw material powder therein. During this process, by moving the outer mold 4 upward while the press forming mold lubricant is supplied via the oil pathway 2 and press forming mold lubricant holding groove 3 to the gap of the outer mold 4 and the lower punch 1, the press forming mold lubricant coated on an inner circumference of the outer mold 4 in wet condition forms lubricant film 5 on the inner circumference of the outer mold 4.

Figure 1D:
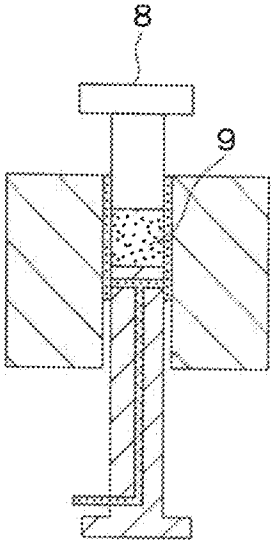

After this, the raw material powder 7 is filled in the cavity 6 which is formed by the outer mold 4 in which the lubricant film 5 is formed on the inner surface thereof and the lower punch 1 (see FIG. 1C), and the raw material powder 7 filled is pressed and formed between an upper punch 8 and the lower punch 1, so as to form a compact 9 having a density ratio not less than 93% (see FIG. 1D). During filling, a part of the lubricant film 5 of the press forming mold lubricant is absorbed in gap among the raw material powder by capillary action. The press forming mold lubricant absorbed is squeezed from gaps among raw material powder to between an inner wall of the outer mold 4 and the compact 9 during pressing and forming, so that the lubricant film 5 of the press forming mold lubricant is held there.

Figure 1E:
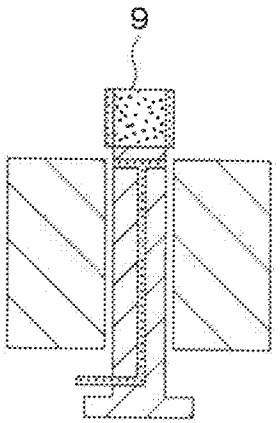

Finally, the compact 9 obtained is extracted from the outer mold 4 by the lower punch 1 (see FIG. 1E). During this process, since the lubricant film 5 of the press forming mold lubricant exists between the inner wall of the outer mold 4 and the compact 9, friction between the inner wall of the outer mold 4 and the compact 9 is reduced, and the compact 9 can be appropriately extracted from the outer mold 4.

The abovementioned method has superior workability in powder compacting forming because there is no need to additionally prepare a coating means such as a sprayer in order to coat the press forming mold lubricant, and the action to form the powder doubles as the action to coat the press forming mold lubricant. Furthermore, in the abovementioned process, during coating of the press forming mold lubricant, it is desirable that the lubricant film 5 be controlled to an appropriate thickness if the amount of liquid calculated from an area to coat the press forming mold lubricant and a thickness of the lubricant film is supplied constant. To supply a constant amount, a freely selected means such as diaphragm pump or syringe pump can be used.

Figure 2A:
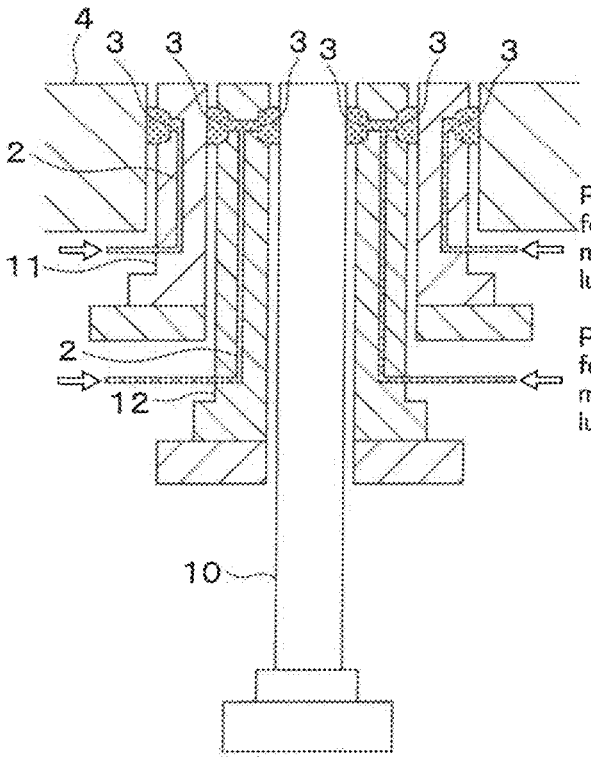
FIG. 2 is a conceptual cross sectional diagram showing a structure of the press forming mold used in another embodiment of the method of forming a compact of the present invention.
Figure 2B:
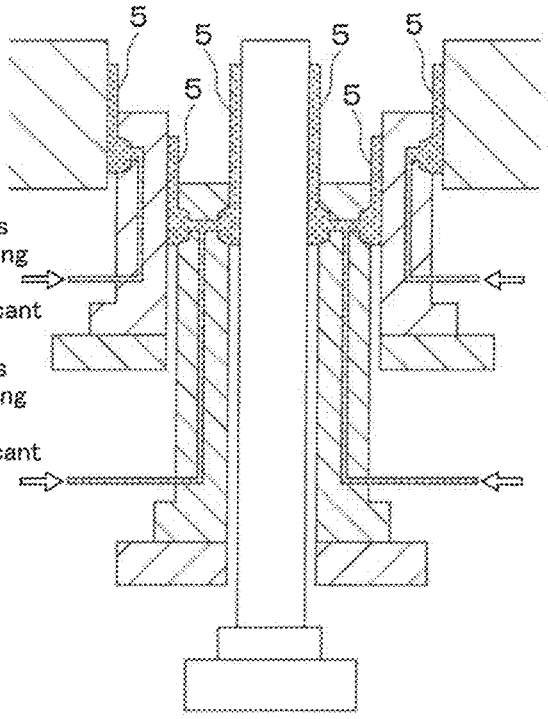

FIGS. 2A and 2B are a conceptual cross sectional view showing a method of coating the press forming mold lubricant on a forming mold used in another embodiment of the method of forming a compact of the present invention. The present embodiment is an example of a case in which a core rod 10 is arranged, and a lower punch consists of two steps that are a primary lower punch 11 and a secondary lower punch 12. In this embodiment, as shown in FIG. 2A, an oil pathway 2 is formed inside of the primary lower punch 11 and the secondary lower punch 12, and in addition, a press forming mold lubricant holding groove 3 is formed near an upper edge of the primary lower punch 11 and the secondary lower punch 12. The press forming mold lubricant is supplied via the oil pathways 2 arranged in the primary lower punch 11 and the secondary lower punch 12 using a pump (not shown), is held in the press forming mold lubricant holding groove 3 formed near an upper edge of the primary lower punch 11 and the secondary lower punch 12, and is further supplied to a gap between the outer mold 4 and the primary lower punch 11, a gap between the primary lower punch 11 and the secondary lower punch 12 and a gap between the secondary lower punch 12 and the core rod 10.

Next, as shown in FIG. 2B, by moving the outer mold 14, the primary lower punch 11, the secondary lower punch 12 and the core rod 10 relative to each other while the press forming mold lubricant is supplied via the oil pathway 2 and the press forming mold lubricant holding groove 3 to a gap between the primary upper punch 11 and the secondary upper punch, the press forming mold lubricant is coated on an inner surface of the outer mold 4, inside surface of the primary lower punch 11 and outer circumferential surface of the core rod 10, so that the lubricant film 5 is formed. According to the abovementioned method, the lubricating film can be formed by coating the press forming mold lubricant onto a surface which contacts and slides with the compact, that is, onto the side surface of the multiple lower punches forming multiple step shape of the compact having the multiple step shape at the lower side thereof, or onto an outer circumferential surface of the core rod forming hole part penetrating along a vertical direction of the compact having a cylindrical shape or the like.

Figure 3A:
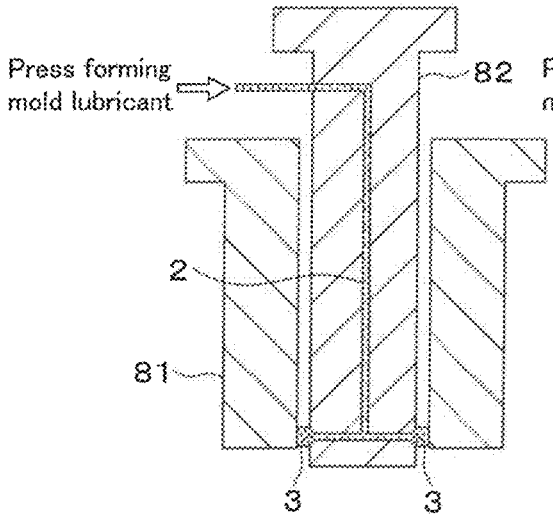
FIG. 3 is a conceptual cross sectional diagram showing a structure of the press forming mold used in another embodiment of the method of forming a compact of the present invention.
Figure 3B:
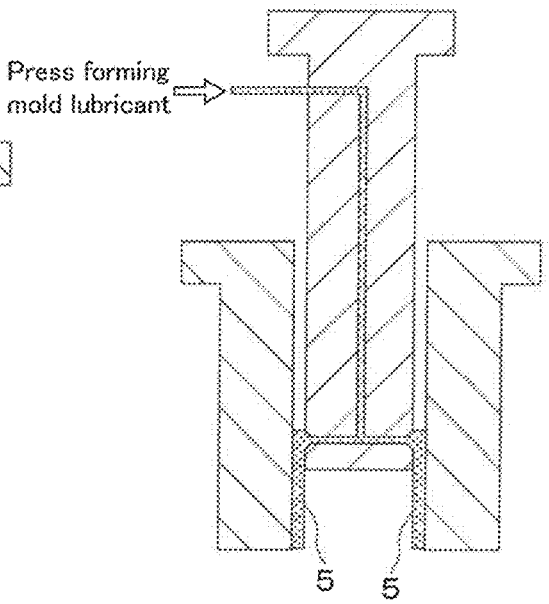

FIGS. 3A and 3B are a conceptual cross sectional view showing a method of coating the press forming mold lubricant to a forming mold used in yet another embodiment of the method of forming a compact of the present invention. The present embodiment is an example of a case in which the upper punch consists of two steps of a primary upper punch 81 and a secondary upper punch 82. In the present embodiment, as shown in FIG. 3A, an oil pathway 2 is formed inside of the secondary upper punch 82, and in addition, a press forming mold lubricant holding groove 3 is formed near a upper edge of the secondary upper punch 82. One end of the oil pathway 2 is connected to a pump (not shown), and the other end is connected to the press forming mold lubricant holding groove 3. Press forming mold lubricant is supplied by the pump via the oil pathway 2 to the press forming mold lubricant holding groove 3, and is further supplied to a gap of the primary upper punch 81 and the secondary upper punch.

Next, as shown in FIG. 3B, by moving the primary upper punch 81 and the secondary upper punch 82 relative to each other while the press forming mold lubricant is supplied via the oil pathway 2 and press forming mold lubricant holding groove 3 to the gap between the primary upper punch 81 and the secondary upper punch 82, the press forming mold lubricant is coated on an inner circumference of the primary upper punch 81, and the lubricant film 5 is formed. According to the abovementioned method, the lubricating film can be formed by coating the press forming mold lubricant onto a surface which contacts and slides with the compact, that is, onto the side surface of the multiple upper punches forming multiple step shape of the compact having the multiple step shape at the upper side thereof.

EXAMPLES

Example 1

Electrolyte copper powder (trade name: CE-15, produced by Fukuda Metal Foil & Powder Co., Ltd.), graphite powder (trade name: SW 1651, produced by Asbery Carbon), and iron powder (trade name: ABC100.30, produced by Hoganas Japan) were prepared, and raw material powder was prepared by mixing 1.5 parts by mass of the electrolyte copper powder and 0.8 parts by mass of the graphite powder to the 100 parts by mass of the iron powder.

A press forming mold lubricant was prepared, in which 10 mass % of graphite (average particle diameter 10 μm) as a solid lubricant and 15 mass % of organic molybdenum (Mo-dialkyldithiophosphate) as an extreme-pressure agent were mixed in a mineral oil.

Using a press forming mold having a structure shown in FIGS. 1A to 1E, the press forming mold lubricant was coated on inner surface of the mold so as to form a lubricating film having thickness of 20 μm, the raw material powder is filled, a compact (sample Nos. 1 to 4) having circular cylinder shape having outer diameter of 20 mm and height of 20 mm was formed to have density shown in Table 1, and the compact was extracted out of an outer mold. The process including the above steps was repeated 20 times continuously for each sample. For each sample, whether or not adhesion on the press forming mold wall occurred, and whether or not noise was generated during extraction from the outer mold were observed. The results are shown in Table 1.

TABLE 1

| Sample No. | Compact density ($Mg/m^3$) | Compact density ratio | Adhesion | Noise during extraction |
|---|---|---|---|---|
| 1 | 7.0 | 91% | No | Yes |
| 2 | 7.2 | 93% | No | No |
| 3 | 7.3 | 94% | No | No |
| 4 | 7.4 | 96% | No | No |

As shown in Table 1, continuous forming was possible without adhesion occurring in each sample; however, in sample No. 1 having a density ratio of 91%, noise was generated during extraction from the outer mold. In sample No. 1 having low density ratio, the press forming lubricant immersed into the raw material during pressing and forming step could not be squeezed out of the compact sufficiently, the oil film might have broken. On the other hand, in samples Nos. 2 to 4 having density ratio of the compact not less than 93%, noise was not generated. It was confirmed that lubricating property during extraction from the outer mold is superior by making the density ratio of the compact not less than 93%.

Example 2

Using the raw material and the press forming mold lubricant in a manner similar to Example 1, the press forming mold lubricant was coated on an inner surface of an outer mold to form a toothed gear shape and on an outer circumferential surface of a core rod so as to form a lubricating film having a thickness shown in Table 2, the raw material powder was filled, a compact having a toothed gear shape of module 2 and number of teeth 23 was formed to have density of 7.4 $Mg/m^3$, and the compact was extracted from the outer mold. The process having the above steps was repeated 20 times continuously for each sample. It should be noted that the thickness of the lubricating film was measured using a Fourier transformation infrared spectrophotometer produced by Shimadzu Corporation. In addition, as a comparison, zinc stearate was dispersed in ethanol, the dispersion was coated on an inner surface of the outer mold and an outer circumferential surface of the core rod, the coating was dried so as to form a lubricating film, the raw material powder was filled, a compact having the toothed gear shape was formed to have density of 7.4 $Mg/m^3$, and the compact was extracted from the outer mold. For each sample, whether or not adhesion on the press forming mold wall occurred was observed. The results are shown in Table 2.

Figure 4:
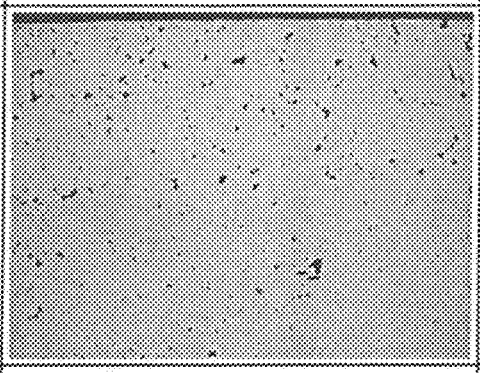
FIG. 4 is a diagram showing a relationship between thickness of lubricating film and pore distribution and surface layer density.
Figure 4:
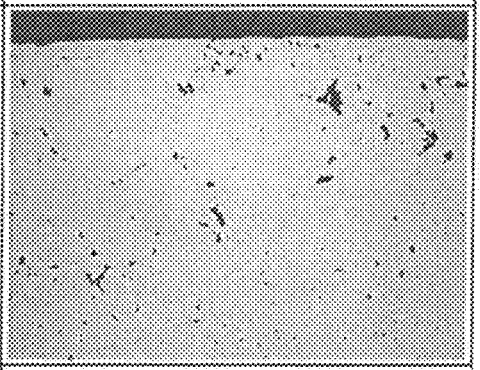
Figure 4:
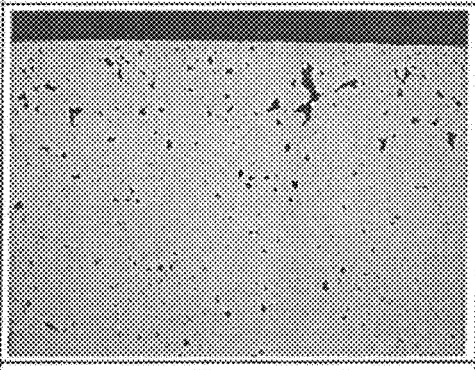
Figure 4:
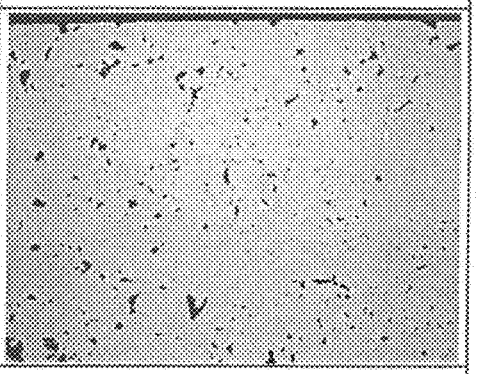
Figure 4:
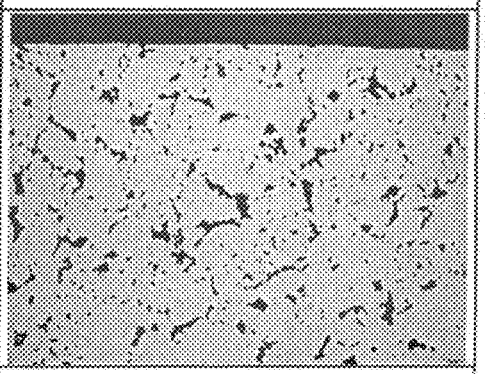

In addition, the compact sample obtained was sintered at 1130° C. in a non-oxidizing atmosphere, pore distribution of a tooth part of the sintered material sample obtained was observed by an optical microscope, and surface layer density was calculated by an image analysis using WinROOF (trade name) produced by Mitani Corporation. FIG. 4 shows pictures of the pore distribution of tooth part of each sample and relationship between the thickness of lubricating film and the surface layer density.

TABLE 2

| Sample No. | Lubricating film thickness (mm) | Compact density ($Mg/m^3$) | Compact density ratio | Adhesion |
|---|---|---|---|---|
| 5 | 3 | 7.4 | 96% | Occurred at 10th |
| 6 | 5 | | | No |
| 7 | 20 | | | No |
| 8 | 40 | | | No |
| 9 | 60 | | | No |
| 10 | — (Zinc stearate (solid)) | | | Occurred at 1st |

As shown in Table 2, in sample No. 10 in which the solid lubricating film of zinc stearate was formed, adhesion occurred at first forming, and continuous forming was difficult. On the other hand, in samples Nos. 6 to 9 having a thickness of the lubricating film not less than 5 μm, continuous forming was possible without adhesion occurring on the press forming mold wall. In sample No. 5 having a thickness of the lubricating film of 3 μm, continuous forming was possible in an early forming processes. However, although continuous forming 20 times was possible in sample No. 5, adhesion occurred in forming the $10^{th}$ and thereafter. This is considered to be because thickness of the lubricating film was small in sample No. 5 and the film might have broken. From the viewpoint of reliability of continuous forming process, it was confirmed that the thickness of the lubricating film is desirably not less than 5 μm.

Furthermore, as shown in FIG. 4, the thicker the lubricating film is, the higher the porosity at the surface layer part of the sintered material is (the lower the density is). This is considered to be because the amount of the press forming mold lubricant immersed in the raw material was increased, the press forming mold lubricant was not squeezed out of the compact during pressing and forming, and was penetrated and remained in the compact. From the viewpoint of product property such as strength, it was confirmed that the thickness of the lubricating film is desirably not more than 40 μm.

Example 3

Except that press forming mold lubricants A, B, C, E and F shown in Table 3 were used (press forming mold lubricant D was one which was used in Example 1), in a manner similar to that in sample No. 4 in Example 1, a process was repeated 20 times continuously in which a compact having a density of 7.4 $Mg/m^3$ was formed and the compact was extracted from the outer mold, and whether or not adhesion on the press forming mold wall occurred was observed in each sample. The results are shown in Table 4.

TABLE 3

| Press forming mold lubricant | Composition (mass %) Mineral oil | Synthetic oil | Graphite | Organic Mo | Viscosity (mPa · s) |
|---|---|---|---|---|---|
| A | — | 100 | — | — | 5 |
| B | 100 | — | — | — | 10 |
| C | — | 100 | — | — | 50 |
| D | 75 | — | 10 | 15 | 300 |
| E | 65 | — | 15 | 15 | 700 |
| F | 45 | — | 10 | 35 | 22000 |

TABLE 4

| Sample No. | Press forming mold lubricant | Viscosity (mPa · s) | Compact density ($Mg/m^3$) | Adhesion |
|---|---|---|---|---|
| 11 | A | 5 | 7.4 | Occurred at 15th |
| 12 | B | 10 | | No |
| 13 | C | | | |
| 4 | D | 300 | | No |
| 14 | E | 700 | | No |
| 15 | E | 22000 | | No |

As shown in Table 4, in samples Nos. 4 and 12 to 15 in which the press forming mold lubricant having viscosity of not less than 10 mPa·s was used, continuous forming was possible without adhesion occurring on the press forming mold wall. On the other hand, also in sample No. 11 in which the press forming mold lubricant having viscosity of 5 mPa·s was used, continuous forming was possible in early forming without adhesion occurring on the press forming mold wall. However, although continuous forming 20 times was possible, adhesion on the press forming mold surface was observed in the $15^{th}$ and subsequent forming in sample No. 11. This is considered to be because the press forming mold lubricant having low viscosity was used and therefore the lubricating film might have broken in sample No. 11. From the viewpoint of reliability of continuous forming process, it was observed that the viscosity of the press forming mold lubricant is desirably not less than 10 mPa·s.

The invention claimed is:

1. A method of forming a compact based on a press forming method, comprising:

filling raw material powder in a cavity formed by:

an outer mold and a lower punch, or an outer mold, a lower punch and a core rod, pressing the raw material powder between an upper punch and the lower punch so as to form a compact, and pressing the compact out of the outer mold, wherein:

before the raw material powder is filled in the cavity, a lubricating film of a press forming mold lubricant is formed on at least a part of an inner surface of the outer mold, or an inner surface of the outer mold and an outer circumferential surface of the core rod, the press forming mold lubricant consists of an oil as a main component, 15 to 35 mass % of an extreme-pressure agent, based on a total amount of the press forming mold lubricant, and 10 to 20 mass % of a solid lubricant, based on the total amount of the press forming mold lubricant, the press forming mold lubricant is formed by adding the solid lubricant and the extreme-pressure agent to a mineral oil, and the press forming mold lubricant has a viscosity in a range of from 700 to 22000 mPa·s at 25° C., and the raw material powder is pressed and formed into the compact so that a density ratio of the compact is not less than 93%.

2. The method of forming a compact based on a press forming method according to claim 1, wherein:

the lower punch consists of multiple lower punches, each surface of the multiple lower punches forms part of an outer circumference of the compact, and the lubricating film of the press forming mold lubricant is formed on a part of the surface of at least one lower punch.

3. The method of forming a compact based on a press forming method according to claim 1, wherein:

the upper punch consists of multiple upper punches, each surface of the multiple upper punches forms part of an outer circumference of the compact, and the lubricating film of the press forming mold lubricant is formed on a part of the surface of at least one upper punch.

4. The method of forming a compact based on a press forming method according to claim 1, wherein a thickness of the lubricating film is from 5 to 40 μm.

5. The method of forming a compact based on a press forming method according to claim 1, wherein the raw material powder contains an iron-based powder as a main component.

6. The method of forming a compact based on a press forming method according to claim 1, wherein the solid lubricant contains at least one selected from the group consisting of graphite, a metal sulfide, a metallic soap, and a wax.

7. The method of forming a compact based on a press forming method according to claim 6, wherein the solid lubricant contains graphite.

8. The method of forming a compact based on a press forming method according to claim 7, wherein the graphite has an average particle diameter of from 1 to 50 μm.

9. The method of forming a compact based on a press forming method according to claim 1, wherein the extreme-pressure agent is molybdenum dialkyldithiophosphate.

10. The method of forming a compact based on a press forming method according to claim 1, wherein:

the filling of the raw material powder in a cavity includes absorption of a part of the press forming mold lubricant in gaps among the raw material powder by capillary action, and the pressing of the raw material powder so as to form the compact includes squeezing the absorbed press forming mold lubricant from the gaps among the raw material powder to between the compact and the wall of the mold by the pressing force.

11. The method of forming a compact based on a press forming method according to claim 1, wherein the raw material powder filled in a cavity formed by an outer mold, a lower punch and a core rod.

* * * * *